United States Patent [19]

Hutchinson

[11] 4,441,271

[45] Apr. 10, 1984

[54] COMBINATION PORTABLE SEAT CUSHION AND PENNANT

[76] Inventor: Earl Hutchinson, 110 Dellwood Ave., Lockport, Ill. 60441

[21] Appl. No.: 399,598

[22] Filed: Jul. 19, 1982

[51] Int. Cl.[3] ..... G09F 21/02

[52] U.S. Cl. ..... 40/584; 5/437; 5/440; 40/159; 40/586

[58] Field of Search ..... 40/584, 10 R, 159, 586; 5/437, 440, 465, 436

[56] References Cited

U.S. PATENT DOCUMENTS

| | | | |
|---|---|---|---|
| 2,013,481 | 9/1935 | Stonehill | 5/437 |
| 3,222,694 | 12/1965 | Schick | 5/440 |
| 3,686,782 | 8/1972 | Erickson et al. | 40/152 |
| 3,761,131 | 9/1973 | Oliver | 5/465 |
| 4,037,340 | 7/1977 | Owensmith | 40/586 |
| 4,190,918 | 3/1980 | Harvell | 5/465 |

*Primary Examiner*—Gene Mancene
*Assistant Examiner*—Wenceslao J. Contreras
*Attorney, Agent, or Firm*—Ernest Kettelson

[57] ABSTRACT

A combination portable seat cushion and pennant comprising a foldable carrying case having two pockets therein in side-by-side relationship foldable along their common border, each pocket having an open end to receive therein respectively a pair of cushions. Each of the cushions comprises a block of foam rubber or plastic or other cushioning material enclosed within an outer covering of flexible sheet material such as plastic, cloth, leather or the like. The cushions are readily removable from their respective pockets of the carrying case for use as pennants and noisemakers during the course of a sporting event. Each cushion includes a broad, substantially flat surface which the spectator can slap together when holding one of the cushions in each hand to use as a noisemaker during the sporting event. Such surfaces also include descriptive material thereon for use as pennants such as team colors, words comprising team cheers and the like which the spectator can display during the game. When the cushions are reinserted into their respective pockets of the carrying case, the carrying case is then folded over with one cushion on top of the other for use as a seat cushion.

8 Claims, 3 Drawing Figures

COMBINATION PORTABLE SEAT CUSHION AND PENNANT

BACKGROUND OF THE INVENTION

This invention relates to the field of portable seat cushions or other personal items which can be carried or worn by an individual and also serve one or more additional purposes.

The prior art in this field includes such things as a scarf which can be worn around a person's neck in the usual manner which has hand pockets at each end so the wearer can hold the scarf above his head in an extended manner to use as a pennant having words or phrases displayed thereon as disclosed in U.S. Pat. No. 4,037,340. A seat cushion which includes the additional function of being self-warming is disclosed in U.S. Pat. No. 3,259,925. A portable seat cushion which can double to provide a back rest, an arm rest and the like when unfolded is disclosed in U.S. Pat. No. 3,061,844. Another portable seat cushion which can be unfolded to provide a back rest in addition to a seat cushion is disclosed in U.S. Pat. No. 2,734,556. A portable seat cushion which includes fastening means for use on the old box-type seats of railway locomotives is disclosed in U.S. Pat. No. 2,218,951. A dual purpose seat cushion and protective apron for draping over the back of park benches and the like to protect the user's clothing is disclosed in U.S. Pat. No. 1,404,451.

These dual purpose items are illustrative of the prior art in this field. The present invention is an improvement by providing a novel two-cushioned seat for added comfort as well as two separate display items for use as pennants which can also serve a third purpose of being noisemakers whereby spectators can participate in making audible cheers for their team.

SUMMARY OF THE INVENTION

It is an object of the invention to provide a portable seat cushion, pennant and noisemaker combination comprising a foldable carrying case having two separate pockets folding one over the other, a block of cushioning material in each of said pockets, each of said blocks of cushioning material including display features thereon and surface areas capable of producing an audible sound when slapped together.

It is an object of the invention to provide a combination portable seat cushion and pennant comprising a pair of cushions to provide a double cushion seat, each cushion being also usable as pennants when held in the user's hands.

DESCRIPTION OF PREFERRED EMBODIMENT

Figure 2:
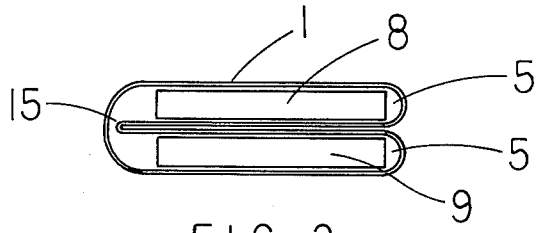
FIG. 2 is an end elevation view of the carrying case and cushions of FIG. 1 shown in folded position with one cushion on top of the other.
Figure 1:
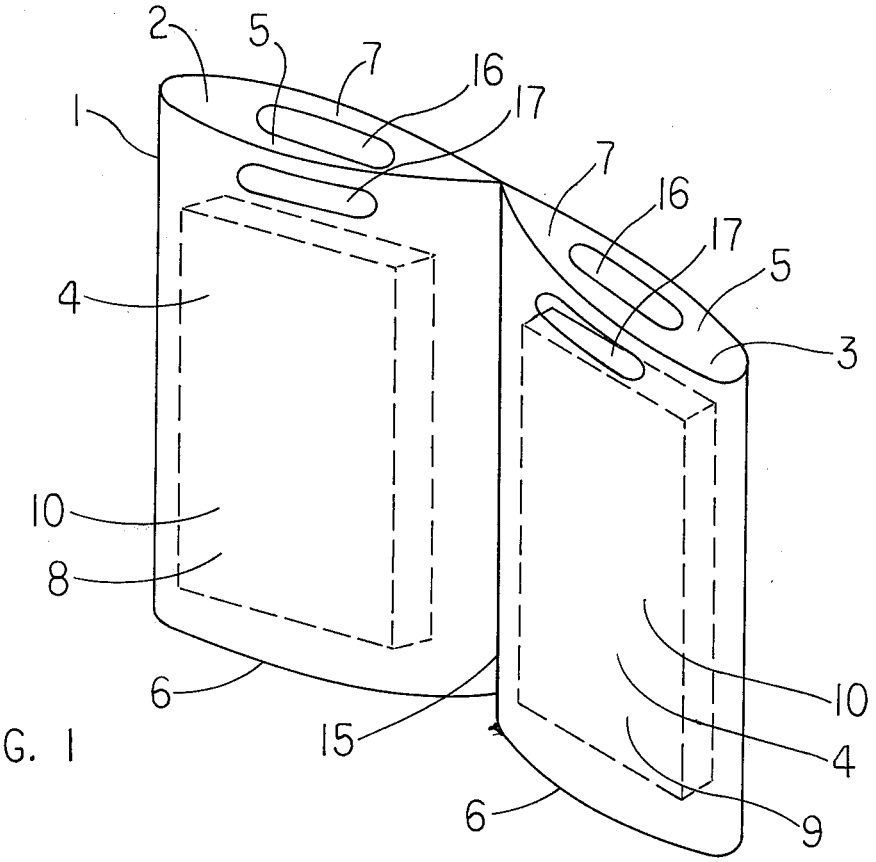
FIG. 1 is a perspective view of a foldable carrying case having two pockets showing in broken lines cushions therein in accordance with this invention.
Figure 3:
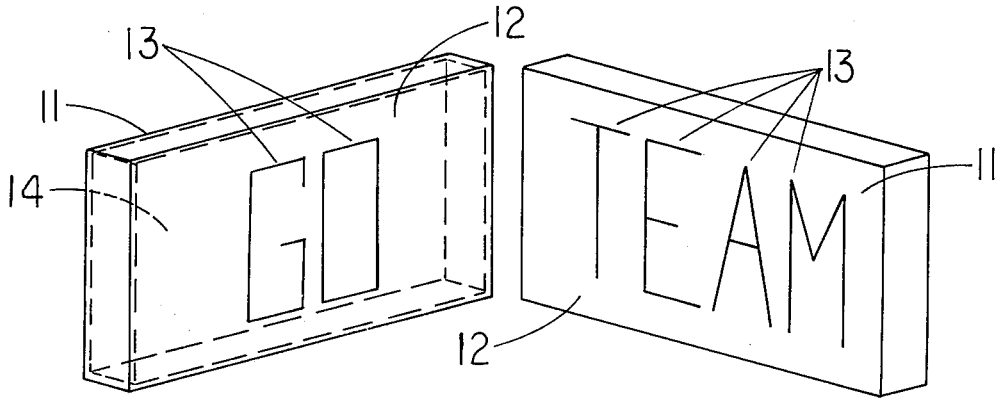
FIG. 3 is a perspective view of the two cushions removed from the pockets of the carrying case, showing descriptive display features thereon for use as a pennant and noisemaker, a block of foam cushioning material illustrated in broken lines within the outer covering of one of the cushions.

A combination portable seat cushion, pennant and noisemaker includes an outer carrying case 1 of flexible sheet material having a first pocket 2 and a second pocket 3. The pockets are formed by a peripheral side wall 4 of each pocket surrounding a cavity 5 in each pocket. The cavity 5 of each pocket is closed at one end 6. The opposite end 7 is open to permit insertion into each pocket and removal from each pocket of respective ones of the pair of cushions 8 and 9.

Each of the cushions 8 and 9 include a block of foam material 10 such as foam rubber, foam plastic, or other comparable material which is enclosed within an outer cushion cover 11. The outer cushion cover 11 is of flexible sheet material such as plastic, leather and other types of flexible sheet material which has a surface that can produce audible sound when slapped together. The pair of cushions 8 and 9 with such covering material can then be used as noisemakers by slapping them together during the course of a sporting event as part of a group or individual cheer.

The outer cushion cover 11 includes a substantially flat broad surface area 12 for slapping together when used as noisemakers. Descriptive display features 13 are also provided on such flat broad surface area for use as pennants during the course of a game, thereby the user can use the pair of cushions 8 and 9 to participate in group or individual cheers by holding one cushion 8 in one hand and the other cushion 9 in the other hand. They can be manipulated as desired by a cheerleader instructing the users to for example raise one cushion 8 to display one feature for part of the cheer, leaving the other cushion 9 out of view, alternating the raising of the other cushion 9 while dropping cushion 8, raising both together, and the like in various display and cheer patterns. Each of the cushions 8 and 9 may also have different descriptive display features 13 on the opposite surface area 14 for further versatility.

The descriptive display features 13 may include such things as team colors, one solid color being on one of the cushions 8, the other team color being on the other cushion 9. The descriptive display feature may include various design features such as a team mascot, or individual letters or figures which a group of spectators can use in combination to display a completed cheer or complete another message. The descriptive display features may also include a word on one cushion 8 such as the word "GO" and a second word on the other cushion 9 such as the word "TEAM" whereby the user can manipulate the cushions as pennants to form the completed cheer "GO TEAM."

The first pocket 2 and second pocket 3 are joined along a common border 15 which may be a stitched seam extending from the closed end 6 to the open end 7 of the pockets 2 and 3 along the adjoining edges. The common border 15 may also be formed by a heat seal in the case where the flexible sheet material used to form the outer carrying case 1 is a heat sealable plastic.

Each of the pockets 2 and 3 include hand grasp means at the open end regions thereof, which in the embodiment shown in the drawings includes a pair of elongated apertures 16 and 17 formed in the peripheral side wall 4 of each pocket 2 and 3, near the respective open ends 7 thereof, each aperture 16 being in registration with its respective corresponding apertures 17. The elongated hand grasp apertures are positioned in each pocket 2 and 3 whereby all four of the elongated hand grasp apertures are in registration with each other when the outer carrying case is folded along its common border 15. The user may then insert his fingers through the aligned apertures to grasp the carrying case 1 for conveniently transporting from one place to the other. The length of the pockets 2 and 3 is sufficiently longer than the corresponding dimension of the cushions 8 and 9, so when they are inserted into their respective pockets 2 and 3, the hand grasp apertures are above and able to clear the cushions 8 and 9.

In use, the spectator may first fold the carrying case 1 with the cushions 8 and 9 in their respective pockets 2 and 3 along the common border 15 whereby one cushion 8 is above the other cushion 9 to provide a double cushion seat for additional comfort when used as a seat cushion. During the course of the game when the spectator desires to use the device as a pennant and noisemaker, he may remove the cushions 8 and 9 from the pockets 2 and 3, holding one cushion 8 in one hand and the other cushion 9 in the other hand. The cushions may then be slapped together as noisemakers. They may also be held by the spectator above his head or otherwise viewable with the surface area 12 having descriptive display features 13 thereon facing forward to display a completed cheer or other completed message. After the cheer or other use as a pennant or noisemaker, the spectator may then reinsert the cushions 8 and 9 into their respective pockets 2 and 3 of the carrying case 1, which he may then fold over with one cushion on top of the other for use again as a comfortable double cushion seat.

I claim:

1. A portable seat cushion and pennant, comprising cushion means to provide a cushioned seat, said cushion means including multiple message completion and display means to display parts of a message in the form of different completed messages when so arranged, said cushion means including a first cushion and a second cushion, said first and second cushions being operatively connected for movement between a first position and a second position, said first position being substantially side-by-side relationship of said first and second cushions, said second position being one of said first and second cushions above the other to provide a double cushion seat, including operative connection means to receive said first and second cushions for movement between said first and second positions, said cushions being removable from said operative connection means for separated and associated use for at least one other purpose than as a cushion, said operative connection means including a carrying case, said carrying case including a first pocket and a second pocket, said first and second pockets each including an open end to receive respective ones of said first and second cushions in said pockets, said pockets being joined in side-by-side relationship along a common border, said pockets being foldable on said common border for operative movement of said pockets between a first position of substantially side-by-side relationship and a second position in which one of said pockets is above the other, wherein said first pocket includes a pair of hand grasp apertures formed in the side wall thereof near said open end, oppositely disposed and each aperture of said pair in substantial registration with each other, said second pocket includes a pair of hand grasp apertures formed in the side wall thereof near said open end, oppositely disposed and each aperture of said pair in substantial registration with each other, both of said pairs of hand grasp apertures being in substantial registration with each other when said first and second pockets are in said position one above the other.

2. A portable seat cushion and pennant as set forth in claim 1, wherein said message completion and display means of said cushions includes a first part of a message on said first cushion, a second part of a message on said second cushion, said cushions being separable from said pockets and individually displayable in a desired arrangement to complete a displayed message.

3. A portable seat cushion and pennant as set forth in claim 2, wherein said first part of a message includes one particular color, said second part of a message includes a particular different color, said colors when displayed completing a message comprising a particular team's colors.

4. A portable seat cushion and pennant as set forth in claim 2, wherein said first part of a message includes a particular word, said second part of a message includes a particular different word, said words when displayed completing a message comprising a particular completed sentence.

5. A portable seat cushion and pennant as set forth in claim 2, wherein said cushions each include an exterior surface of material which produces a substantial audible sound when such surface of one of said cushions is slapped against such surface of the other of said cushions.

6. A portable seat cushion and pennant as set forth in claim 5, wherein said cushions each include a block of compressible foam material, and each include an outer cushion covering of flexible sheet material which produces a substantial audible sound when said cushions having such cushion coverings are slapped together.

7. A portable seat cushion and pennant as set forth in claim 6, wherein said outer cushion covering of flexible sheet is plastic.

8. A portable seat cushion and pennant as set forth in claim 6, wherein said outer cushion covering of flexible sheet material is leather.

* * * * *